United States Patent [19]

Hamill, Jr. et al.

[11] Patent Number: 4,683,937

[45] Date of Patent: Aug. 4, 1987

[54] INGOT MOLD AND METHOD OF PRODUCING SAME

[75] Inventors: Paul E. Hamill, Jr., Penn Township, Westmoreland County; Macy W. Vance, Monroeville, both of Pa.

[73] Assignee: United States Steel Corporation, Pittsburgh, Pa.

[21] Appl. No.: 298,867

[22] Filed: Sep. 3, 1981

Related U.S. Application Data

[63] Continuation of Ser. No. 767,917, Mar. 4, 1977, abandoned.

[51] Int. Cl.[4] ..... B22C 3/00; B22D 7/06

[52] U.S. Cl. ..... 164/125; 164/138; 164/364; 164/DIG. 6; 249/174

[58] Field of Search ..... 164/33, 122, 125, 138, 164/364, DIG. 6; 249/174, 114, 134, 204

[56] References Cited

U.S. PATENT DOCUMENTS

| | | | |
|---|---|---|---|
| 1,262,719 | 4/1918 | Walker | 164/DIG. 6 |
| 1,651,835 | 12/1927 | Ramage | 164/DIG. 6 |
| 4,081,020 | 3/1978 | Cattell et al. | 164/122 |
| 4,250,946 | 2/1981 | Monta | 164/138 X |

FOREIGN PATENT DOCUMENTS

| | | | |
|---|---|---|---|
| 1934078 | 1/1970 | Fed. Rep. of Germany | 164/138 |

*Primary Examiner*—Nicholas P. Godici
*Attorney, Agent, or Firm*—Forest C. Sexton

[57] ABSTRACT

A process for casting ingot molds wherein a smooth, rigidized insulative board is used to form the as cast bottom surface of the ingot mold to produce a smooth flat surface which does not require machining and to permit slow cooling and solidification so that a uniform macrostructure and microstructure is effected.

11 Claims, 3 Drawing Figures

INGOT MOLD AND METHOD OF PRODUCING SAME

This is a continuation of application Ser. No. 767,917, filed Mar. 4, 1977, now abandoned.

Ingot molds used in the production of steel ingots usually consist of upright cast iron, box-like shells open at one or both ends, and weigh from 0.8 to 1.5 times as much as the ingot cast therein. To close the bottom for casting steel in those molds open at both ends, i.e., either big-end-down open-top or big-end-down bottle-top molds, the mold is placed upright, big end down on a thick cast iron stool, which serves as the bottom closure for the mold cavity. A reasonably close fit between the mold and stool should be assured to prevent leakage of molten steel therebetween. Those molds which are open at one end only, i.e. big-end-up closed bottom molds, are already closed and hence need no mold stool in combination therewith. It is common practice, however, to place a hot-top over the open end of this type mold when steel is cast therein. Here again it is necessary that a reasonably close fit be maintained between the mold and hot-top to prevent leakage of molten steel therebetween.

Ingot molds are usually manufactured in accordance with long established foundry techniques wherein a suitable cavity is formed within a sand mold and cast iron poured into the cavity and allowed to solidify in the shape thereof. Although the as-sand-cast surface of the resulting mold is suitable for most surfaces, it has been necessary to machine the as sand cast bottom surface of a newly cast big-end-down type mold to provide a smooth, flat surface. This is because the bottom surface of the mold must rest securely against the mold stool during teeming as noted above for big-end-down molds. Even the as-sand-cast upper surface of big-end-up closed bottom molds must also be machined to provide a smooth flat surface to form a good seal with the hot top placed thereon. To avoid confusion hereinafter, these surfaces which must be flat and smooth will be referred to as "big-end surfaces" rather than "bottom surfaces" in the case of big-end-down open and bottle-top molds and "top surfaces" in the case of big-end-up closed bottom molds.

Since such machining operations are of course costly and time-consuming, alternate methods of producing ingot molds having smooth, flat big-end surfaces have been developed. Specifically, chill casting techniques are widely used wherein an iron plate is incorporated into the mold for making ingot molds to form the big-end surface of the ingot mold cast thereagainst. Since the chill-plate is smoother than the said mold surface and more resistant to iron erosion, the resulting big-end surface on the ingot mold is sufficiently smooth and flat that no machining is required. This of course works equally well with closed bottom molds as they are usually cast upside down so that the big-end of the opening can be formed on such a chill-plate.

Although chill-casting does reduce production costs of ingot molds by eliminating the need for any machining and also eliminates the need for placing sand in the casting stool, there are certain disadvantages to chill-casting which minimize over-all cost savings and may in fact increase total over-all costs. Specifically, ingot molds cast on chill-casting stools have a considerably shorter useful life than do molds cast on sand stools. One study has shown that ingot molds cast on sand stools have a 22% longer life than ingot molds cast on chill casting stools. This difference in mold life is primarily due to the differences in macrostructure and microstructure between sand-cast surfaces and chill-cast surfaces. The sand-cast surfaces cool more slowly resulting in a more uniform, macrostructure and microstructure, which is less crack-sensitive.

In order to overcome the above-noted disadvantages of chill-casting ingot molds, a process has been developed whereby an insulative coating is applied onto the chill casting stool to reduce the cooling rate of the cast iron thereagainst. Although this technique has achieved some degree of success, there are a number of shortcomings associated therewith. For example, the chill plate surface must be clean to permit adherence of the coating, the coating adherence to the chill plate then necessitates cleaning the plate prior to reuse, care must be exercised to coat uniformly, coating materials may not adhere to chill plates which are too hot (containing heat from a previous use) or too cold, and the coating may need to be dried to remove any moisture therefrom.

It is an object of this invention to provide a new method for manufacturing ingot molds which overcomes the above described disadvantages of sand-casting and chill-casting stools.

Another object of this invention is to provide a method for manufacturing ingot molds which produces a smooth, flat as cast big-end on the ingot mold which does not require machining and yet is characterized by a microstructure similar to that produced with a sand-casting stool.

A further object of this invention is to provide a method for manufacturing ingot molds which incorporates a rigidized fibrous board having insulative properties against which the cast big-end of the ingot mold is formed.

These and other objects and advantages will become apparent from a full understanding of the following description and attached drawings of which:

As already noted, the crux of this invention resides in the use of a rigidized insulation board to form the big-end surface of the mold cavity so that such surface of the ingot mold formed thereby will cool and solidify more slowly to yield a uniform macrostructure and microstructure resulting in a longer service life similar to that obtained with a sand casting stool, and yet having a smooth flat surface which need not be machined similar to that produced with a chill-casting stool. To this end, the rigidized insulation board can be incorporated into either conventional sand-casting techniques and equipment or conventional chill-casting techniques and equipment. Simply stated then the process of this invention involves the casting of an ingot mold in a conventional sand mold having neither sand nor a chill-plate forming the big-end surface of the mold cavity, but rather having a rigidized insulation board. Obviously, there are numerous forms and techniques by which such an insulation board could be incorporated into a mold to form the big-end surface of the mold cavity. Perhaps the simplest method is to produce a conventional sand mold wherein a large flat insulation board is provided as the stool, and a sand mold placed thereover.

Figure 1:
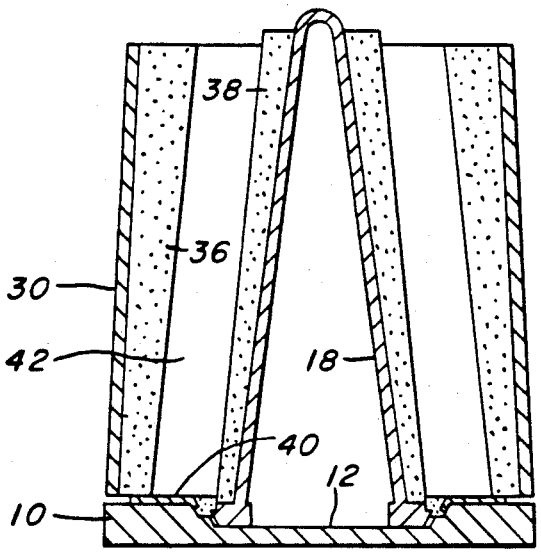
FIG. 1 is a schematic sectional view of a mold as set up to cast an ingot mold according to one embodiment of this invention.
Figure 2:
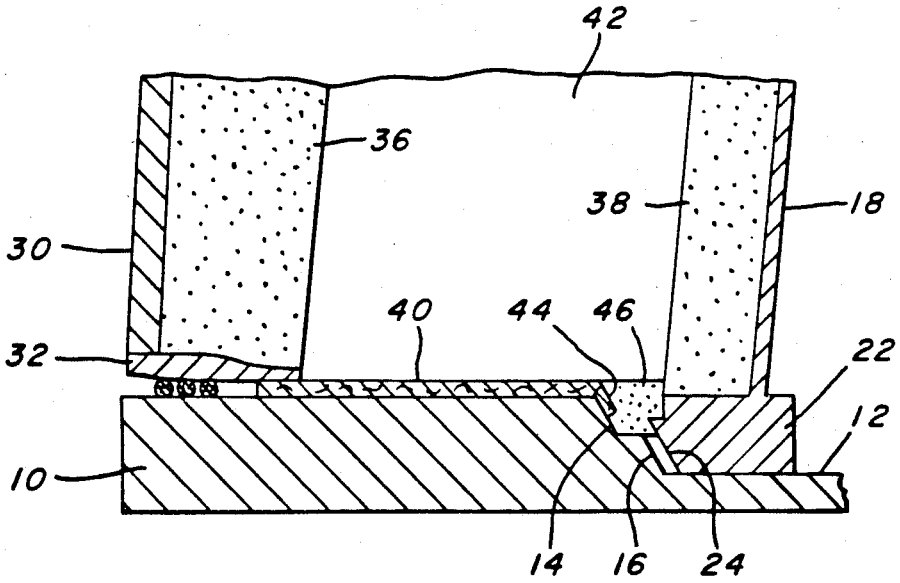
FIG. 2 is a close-up sectional view of the lower left-hand portion of the cavity shown in FIG. 2.
Figure 3:
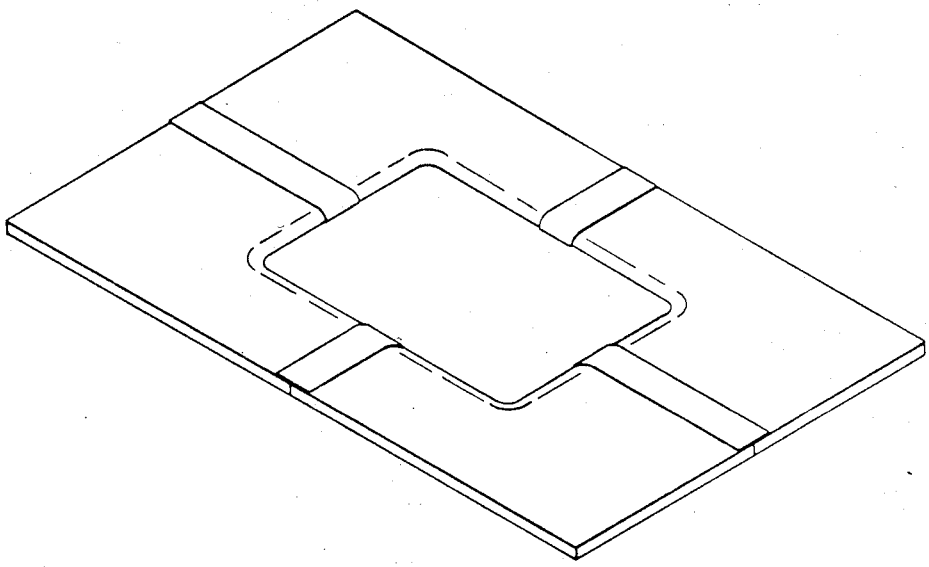
FIG. 3 is a prospective view of the rigidized fibrous board of this invention as used in the FIG. 1 embodiment.

One method we have preferred to use is illustrated in FIGS. 1 and 2 and utilizes conventional chill-casting equipment with a separable core barrel and stool. Equally good results can be achieved with an integral stool and core barrel. This first mentioned equipment comprises a chill casting stool 10 having a shallow cavity 12 in the center thereof. Cavity 12 has two sloped walls 14 and 16. A hollow core barrel 18 having a flange 22 is designed to set into cavity 12 so that sloped wall 24 on flange 22 mates reasonably with the lower sloped wall 16 in cavity 12. This arrangement is provided to assure that core barrel 18 is positioned at the center of chill-casting stool 10 when the mold is assembled for casting. An outer flask 30 having a sand retaining ring 32 is adapted to be set on the periphery chill casting stool 10 encircling core barrel 18 at a sufficient distance to form the desired cavity.

To prepare the above equipment for casting an ingot mold, it is first necessary to compact molding sand 36 against the inside surface of flask 30 to shape the outer walls of the intended ingot mold, and to compact molding sand 38 against the outer walls of core barrel 18 to shape the inside wall of the intended ingot mold. When the molding sand 38 is in place, core barrel 18 is placed into the cavity 12 in chill-casting stool 10. According to prior art practice, molding sand 46 is then compacted into the annular space provided between core barrel 18 and surface 14 on stool 10 and then the flask 30 is positioned in place. Contrary thereto, the practice of this invention then requires that a rigidized insulation board 40 be placed over chill-casting stool 10 to form the bottom surface of cavity 42. Rigidized insulation board 40 has an annular configuration so as to completely encircle core barrrel 18. In order to seal board 40 against chill-casting stool 10 to prevent molten metal from getting therebetween, the inside edge of board 40 can be angled downward to form a lip 44 which mates with wall 14 of cavity 12. Molding sand 46 is then compacted between lip 44 and flange 20 or core barrel 18 to provide a smooth extension from the upper surface of board 40 to core sand 38. Rigidized insulation board 40 is of sufficient width so that the outer edge thereof will extend under sand retaining ring 30 to seal the outer edge thereof. Lastly, a flask-stool sealant 48 is placed around the edge of chill-casting stool 10, encircling board 40, and then flask 30, to which ring 32 and sand 36 are attached, is placed thereover to form cavity 42. It should be noted that sealant 48 is not always necessary.

The moderately complicated inside sealing arrangement, i.e. the interplay between lip 44 and molding sand 46, is somewhat necessitated by the specific design of the chill casting equipment used. Other equipment designs which utilize flat chill casting stools can employ a more simplified board design. For example, the inside edge thereof may be flat and extend under the core barrel and sealed in much the same manner as the outside edge is sealed under flask 30, as shown.

In addition to the basic mold construction as shown in the drawings as described above, it is of course necessary to provide a basin, runner and gate (not shown) according to conventional practice through which the mold is cast.

The rigidized insulation board 40 can be made from any insulative material which can be formed into a smooth board which will not deteriorate or erode when contacted by the molten iron during or after casting. For this material we have preferred to use a mixture of aluminosilicate fibers, such as KAOWOOL or FIBERFRAX and a colloidal silica binder. The fibers are first felted from a chopped fiber and binder slurry and compressed to form a board shape by conventional vacuum forming techniques. Thereafter, the form is dried at 220° F. to remove and provide increased rigidity and strength. Increased strength may be necessary to support loads caused by the ferrostatic head when the ingot mold is cast, as well as provide adequate erosion resistance. This can be accomplished by reimpregnating the dried board with colloidal silica, or by adding inorganic fillers, such as hollow glass spheres or powders, which may also be substituted for fibers to lower material costs. In addition, mineral wool or calcium silicate fibers may be substituted. We have found that suitable boards are characterized by the following properties: thickness, $\frac{1}{4}$ to $\frac{1}{2}$ inch; density, 15–30 lb/cu.ft.; thermal conductivity, 1–2 Btu-in./sq.ft./°F./hr. In addition, the above described materials are quite suitable in that they will not stick to the cast metal, and can be applied to hot as well as cold chill-casting stools.

The above detailed embodiment is of course tailored to be used with the specific chill-casting equipment utilized. It would be obvious therefore that the details would vary somewhat with other types of equipment. For example, when chill casting equipment is not available, the insulative board 40 could consist of a simple flat disk shaped board embedded into the upper surface of a sand stool.

During the investigations attempting to solve the problems discussed above, several different approaches were tested such as the use of insulative sheets and spray coatings. All such tests were considered unsatisfactory. The use of an insulative board in the production at the laboratory of a 7"×7" cast iron ingot did result in the production of a smooth surface as well as a macrostructure and microstructure resembling that desired. As a result of the successful laboratory trial, an initial plant trial was conducted in which three ingot molds ranging in weight from 35,800 lb. to 51,200 lb. were produced on insulating boards glued to the chill casting stool. All three molds had smooth flat bottoms that did not require machining. One of the molds had 59 pours before condemnation which was considerably better than the consumption rate for the mold size. (The other two molds were lost.) As a result of the successful laboratory trial and initial plant trial, eight commercial sized ingot molds (46,440 lb) were produced using a procedure substantially as descirbed above. The boards used were $\frac{3}{8}$-inch thick and made of aluminosilicate fibers bonded and rigidized with colloidal silica. Several individual pieces were used and taped together with fiberglass tape but were not attached to the stool. The table below shows the results of that test.

| Mold No. | Bottom Machined | Total No. of Pours Before Scrapping |
|---|---|---|
| 38 | Yes | 45 |
| 39 | No | 72 |
| 41 | No | 72 |
| 44 | No | 18 |
| 45 | No | 54 |
| 48 | No | Mold Lost |
| 49 | No | 59 |

-continued

| Mold No. | Bottom Machined | Total No. of Pours Before Scrapping |
|---|---|---|
| 50 | Yes | 33 |

In the above test, all of the as-cast bottoms produced were quite smooth as compared to sand-cast surfaces. Mold No. 38 could have been used without machining but was nevertheless machined to remove a very slight ridge at the core seal. Mold No. 50 required machining because of difficulties encountered which were considered unusual. After casting, the boards were easily separated from the casting. In a few places where portions of the boards did stick to the casting, such portions were easily scraped off with a putty knife. As shown in the table, all molds had good life, except for Mold No. 44. It is believed, however, that this mold may well have failed due to causes other than macrostructural and microstructural defects in the bottom surface. Mold 48 was lost in the mill and could not be traced. At the time these test molds were made, other conventional ingot molds made at the same time with chill casting techniques were noted and their histories followed. These other ingot molds were scrapped after a total number of pours ranging from 31 to 54. The over-all life improvement can readily be seen.

We claim:

1. A method of manufacturing a cast iron ingot mold having a smooth, flat as-cast big-end surface comprising, casting the ingot mold in a sand mold having a smooth, flat rigidized fibrous insulative board incorporated into the sand mold such that the big-end surface of the resulting ingot mold is formed thereagainst at a cooling rate sufficient to yield a macrostructure and microstructure similar to that effected in an as-sand-cast surface.

2. A method according to claim 1 in which rigidized insulative board is horizontally disposed near the bottom of said sand mold so that said board forms the bottom surface of the cavity in said sand mold.

3. A method according to claim 1 in which said sand mold is formed by placing the rigidized insulative board on a mold stool; placing a core barrel, having a molding sand outer surface, on said stool and placing a molding flask, having a molding sand inner surface, on said stool encircling said core barrel and spaced therefrom to provide a cavity around said core barrel wherein the bottom surface of said cavity is defined by said insulative board.

4. A method according to claim 3 in which said molding stool is a sand stool.

5. A method according to claim 3 in which said molding stool is a chill-casting stool.

6. A method accroding to claim 3 in which a sealant is deposited between said insulative board and the core barrel, and between said insulative board and the molding flask to prevent molten metal from seeping therebetween.

7. A method according to claim 1 in which said rigidized insulative board has a thickness of from $\frac{1}{4}$ to $\frac{1}{2}$ inch.

8. A method according to claim 7 in which said rigidized insulative board has a density of 15 to 30 lb/cu ft. and a thermal conductivity of 1 to 2 Btu-in/sq.ft./°F./hr.

9. A method according to claim 1 in which said rigidized insulative board consists of a mixture of a colloidal silica binder and a fibrous material selected from the group consisting of aluminosilicate fibers, mineral wool, and calcium silicate fibers.

10. A method according to claim 9 in which said rigidized insulative board is strengthened by the addition of inorganic fillers.

11. A cast iron ingot mold having a smooth, flat as-cast big-end surface with a macrostructure and microstructure at said surface similar to that effected in as-sand-cast surfaces.

* * * * *